US006245429B1

(12) United States Patent
Onishi et al.

(10) Patent No.: US 6,245,429 B1
(45) Date of Patent: Jun. 12, 2001

(54) PROTECT LAYER TRANSFER SHEET

(75) Inventors: Jiro Onishi; Katsuyuki Oshima, both of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/276,631

(22) Filed: Mar. 25, 1999

(30) Foreign Application Priority Data

Mar. 27, 1998 (JP) ..... 10-081285

(51) Int. Cl.[7] ..... B41M 5/035; B41M 5/38

(52) U.S. Cl. ..... 428/447; 428/195; 428/913; 428/914; 503/227

(58) Field of Search ..... 428/195, 913, 428/914, 447; 503/227; 8/471

(56) References Cited

U.S. PATENT DOCUMENTS 5,576,356 * 11/1996 Leir et al. ..... 522/31
5,646,089 7/1997 Oshima et al. ..... 503/227

FOREIGN PATENT DOCUMENTS 0687574 6/1995 (EP) .
0743194 11/1996 (EP) .

* cited by examiner

*Primary Examiner*—Bruce H. Hess
(74) *Attorney, Agent, or Firm*—Ladas & Parry

(57) ABSTRACT

A protect layer transfer sheet of the present invention comprises a substrate, an untransferable release layer and a thermally transferable protect layer, the protect layer being disposed on at least one area of a surface of the substrate by the medium of the release layer. The untransferable release layer comprises at least a cross-linking resin having a chemical structure comprises at least a side chain A and a side chain B on a principle chain formed of a carbon chain, and cross-linking at least a part of the side chain A and the side chain B. Therefore, the adhesive strength between the substrate and the untransferable release layer can always be stronger than the adhesive strength between the untransferable release layer and the thermally transferable protect layer.

5 Claims, 2 Drawing Sheets

PROTECT LAYER TRANSFER SHEET

BACKGROUND OF THE INVENTION

The present invention relates to a protect layer transfer sheet in which a protect layer is disposed on a substrate to be separable therefrom, and particularly relates to a protect layer transfer sheet which can surely transfer a protect layer onto a printed product, thereby providing durability to an image previously formed on a surface of the printed product through a thermal transfer recording or another transfer recording process.

The present invention also relates to a protect layer to protect a quality image on a printed product obtained through any of transfer recording processes such as a sublimation thermal transfer process, an ink jet printing process or the like.

There have been known thermal transfer methods such as a sublimation (type) thermal transfer method and a heat fusion (type) thermal transfer method. The sublimation thermal transfer method is carried out by: using a sublimation thermal transfer sheet in which a dye layer containing a sublimation dye and a binder is formed on a substrate film; laying the sublimation thermal transfer sheet on a transfer-receiving material; heating the sublimation thermal transfer sheet by a heating means such as a thermal head or a laser beam in accordance with information or signals for transferring of an image in order to sublimate the dye from the dye layer and transfer it to the transfer-receiving material, thereby recording or outputting the image. On the other hand, the heat fusion thermal transfer method is carried out by: using a heat fusion thermal transfer sheet in which a heat fusible ink layer containing a coloring material such as pigment and a vehicle such as wax is formed on a substrate film; laying the heat fusion thermal transfer sheet on a transfer-receiving material; heating the heat fusion thermal transfer sheet by a heating means similar to that in the sublimation thermal transfer method in order to soften or fuse a ink in the heat fusible ink layer and transfer it to the transfer-receiving material, thereby recording or outputting the image.

The sublimation thermal transfer method of the former is a particularly excellent method to form a precise and beautiful image having a gradational tone such as a photograph of a portrait. The heat fusion thermal transfer method of the latter is particularly suitable for a case where a simple image such as a letter, a numeral or the like is easily and clearly formed. Various kinds of images is easily formed by these thermal transfer methods, and hence the thermal transfer methods are getting preferably utilized for printing a printed product in which a relatively small amount of copies are merely required, for example, a card such as an identification card, various kinds of certifications, or a portrait of the deceased, which often has a large size with completely reproduced colors.

However, since the image formed through the sublimation thermal transfer has no vehicle, it is inferior in durability such as light resistance, weather resistance, wear and abrasion resistance, chemical resistance, solvent resistance or the like to an image formed with an usual ink. In addition, though the image formed through the heat fusion thermal transfer method is supported by the vehicle, it is also inferior in durability to the image formed with an usual ink, and particularly inferior in the wear and abrasion resistance.

There has been known a method for improving the durability of the printed product formed through the thermal transfer process, which is carried out by: laying a protect layer transfer sheet provided with a resinous layer having a thermally transferability, i.e., a thermally transferable protect layer, over an image previously formed through the sublimation or the heat fusion thermal transfer method; and transferring the resinous layer by a heating means such as a thermal head or a heating roll, thereby forming a protect layer on the image. When the protect layer is formed over the image of the printed product, the image can be improved concerning the wear and abrasion resistance, the chemical resistance, the solvent resistance or the like. The light resistance of the image can also improved by adding an ultraviolet absorbent into the protect layer. Furthermore, the protect layer may effect an extra function such as prevention of falsification or counterfeitness, improvement in whiteness of the printed product or the like if a fluorescent whitening agent or the like is added into the protect layer.

In order to surely and constantly transfer the protect layer on the image of the printed product at all times, the protect layer formed on a substrate of the protect layer transfer sheet is required to be quickly and surely transferred on a surface of the image and bonded thereto when the protect layer transfer sheet is heated from its back surface by the heating means such as the thermal head, the heating roll or the laser beam. Thus there has been made an attempt to improve transferability of the protect layer by disposing a transferable protect layer on a substrate of the protect layer transfer sheet by the medium of a release layer.

When the release layer is utilized for improving the transferability of the protect layer, a primary requirement is that a boundary portion between the substrate of the protect layer transfer sheet and the release layer always has a sufficiently large adhesive strength in comparison with that between the transferable protect layer of the protect layer transfer sheet and the release layer. If a relationship between the adhesive strengths of the two boundary portions becomes reverse to that as described above, the release layer which ought not to be transferred will be transferred on the printed product together with the protect layer. That is, a phenomenon called as "robbing of the release layer" is caused.

In addition, it is desirable that the adhesive strength between the release layer and the transferable protect layer is sufficiently large when a heating energy is not applied, and it becomes sufficiently small when the heating energy is applied. If the adhesive strength between the release layer and the transferable protect layer is not enough before applying of the heating energy, an unintentional peeling off of the protect layer or a defective edge of the transferred protect layer (i.e., deterioration of a sharpness of the edge of the transferred protect layer) may be caused. If the adhesive strength described above is excessive at the applying of the heating energy, a noise of the peeling or a sticking may be caused during the transferring process of the protect layer, and furthermore a defect of transferring or conveying may be caused in worse case.

Further, it is desirable that an adhesive strength between the release layer and the transferable protect layer does not depend on temperature and humidity of environment. In case the adhesive strength between the release layer and the transferable protect layer depends on the temperature and the humidity, it causes the defects of the protect layer transferring when the layers are preserved under the condition of high temperature or high humidity for a long period of time, or the protect layer is transferred under the condition of high temperature or high humidity.

The conventional protect layer transfer sheet however has the same tendency in the adhesive strength between the release layer and the transferable protect layer at all times whether the heating energy is applied or not. More specifically, if the adhesive strength between the release layer and the transferable protect layer is made large before the applying of the heating energy, that after the applying of the heating energy will also increase. On the other hand, if the adhesive strength described above is made small after the applying of the heating energy, that before the applying of the heating energy will also decrease. Therefore it has not been possible to obtain a release layer or a transferable protect layer which has adhesive characteristics desirably changeable as stated above.

Further, when the conventional protect layer transfer sheet is used, the condition of preserving the protect layer transfer sheet and transferring has to be greatly limited for transferring the protect layer excellently, because the adhesive strength between the release layer and the transferable protect layer is varied in accordance with the temperature and the humidity during preservation and transferring.

In another aspect, the sublimation thermal transfer method among the thermal transfer recording method is particularly coming capable of forming a beautiful image having gradational tones with a high reproducibility, which is comparable to a photograph. An ink jet system of the transfer recording method is also coming to realize a high quality of the image comparable to the photograph. Therefore such transfer recording methods as can obtain the highly quality image are developing as a technique substitutive for a silver photograph. However, the image formed through the sublimation thermal transfer method or the ink jet method is inferior in the durability to the image formed through the silver photograph method.

As one method to improve the durability of the image formed through the transfer recording method, there has been known a method described above in which the image is covered with the protect layer through thermal-transferring the protect layer from the protect layer transfer sheet. In the conventional protect layer transfer sheet, the thermally transferable protect layer is laminated on the substrate by the medium of the untransferable release layer in order to improve the transferability of the protect layer, and furthermore an adhesive layer is formed as an uppermost layer of the protect layer in order to improve an adhesive property of the transferable protect layer to a surface of the printed product. In addition, since the conventional protect layer transfer sheet has a principal objective to protect a surface of a card such as an identification card or a credit card, it is required to have a high durability as endures a relatively severe condition, such as a high resistance to rubbing, a resistance to plasticizer desired at the time when the card is put in a holder of polyvinyl chloride and left at a high temperature. In order to ensure the high durability, the conventional thermally transferable protect layer is often formed by laminating plural layers each of which mutually has a different function. Therefore the transferable protect layer of the conventional protect layer transfer sheet has a multi-ply structure, because the protect layer has at least the adhesive layer in addition to a main layer or a main ply, and furthermore another layers or plies may be incorporated for providing plural function to the protect layer.

However, the multi-ply structure of the protect layer is apt to deteriorate a transparency of the protect layer and decrease the highest density of the image, thereby being not desirable for protection of a highly quality image. Furthermore the multi-ply structure of the transferable protect layer is inferior in a heat dissipation from the protect layer transfer sheet during the thermal transfer process, thereby deteriorating the sharpness of the edge of the transferred protect layer.

In addition, when the transfer recording method is carried out in place of the silver photograph technique, the high durability as desired in the cards is generally not required. For example, if a printed product formed through the transfer recording method is stuck in an album and preserved, it is enough for the printed product to have a fingerprint resistance (i.e., a resistance to a sebum) or a rubbing resistance enduring a light friction such as rubbing of a eraser at an ordinary temperature. Therefore the conventional transferable protect layer having the multi-ply structure has an excessive performance when it is utilized as the substitutive technique for the silver photograph, resulting in a deterioration of productivity and a rise of cost.

SUMMARY OF THE INVENTION

The present invention has been achieved in consideration of the circumstances mentioned above. A first object of the present invention is to provide a protect layer transfer sheet which can surely and constantly transfer a protect layer on an image of a printed product at all times. A second object of the present invention is to provide a protect layer transfer sheet which is suitable for protecting a highly quality image formed through a transfer recording method.

These and other objects can be achieved according to the present invention by providing a protect layer transfer sheet, which comprises a substrate, an untransferable release layer and a thermally transferable protect layer, the protect layer being disposed on at least one area of a surface of the substrate by the medium of the release layer, wherein the untransferable release layer contains at least a cross-linking resin having a chemical structure which comprises at least a side chain A expressed a following chemical formula 1 and a side chain B expressed a following chemical formula 2 on a principle chain formed of a carbon chain, and cross-linking at least a part of the side chain A and the side chain B.

1

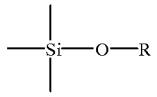

2

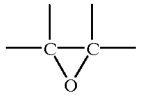

(In the chemical formula, R indicates a hydrogen atom or an alkyl group)

On the above mentioned protect layer transfer sheet, it is preferable that:

(1) an amount ratio of the side chain A is within the range of 3–40 weight % with respect to the total weight of the above described high molecular compound;

(2) the cross-linking resin is further comprises —OH group as a side chain C; and (3) the side chain A has a chemical structure expressed a following chemical formula 3, and the side chain B has a chemical structure expressed a following formula 4, respectively.

3

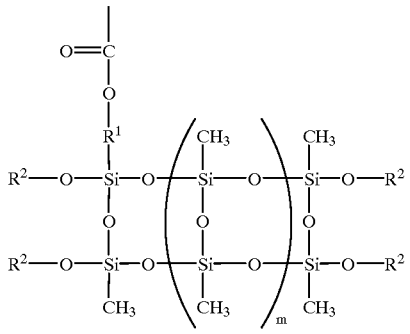

(In the formula, $R^1$ indicates an alkylene group, $R^2$ indicates an alkyl group, and m indicates an integer not less than zero. Each $R^2$ has the same formula or has a different formula.)

4

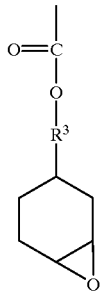

(In the formula, $R^3$ indicates an alkylene group.)

According to the present invention in which the resin comprised the particular high molecular compound uses as the untransferable release layer of the protect layer transfer sheet, an adhesive strength between the substrate and the untransferable release layer can be made sufficiently large at all times in comparison with that between the untransferable release layer and the thermally transferable protect layer. In addition, the adhesive strength between the untransferable release layer and the thermally transferable protect layer can be set or controlled, before and after applying of a heating energy, so as to satisfy the following equation 1, $$Ad(BEFORE)>Ad(AFTER) \quad \text{[EQUATION 1]}$$

In the above equation:

Ad(BEFORE) is the adhesive strength between the untransferable release layer and the thermally transferable protect layer before applying of the heating energy; and Ad(AFTER) is that after applying of the heating energy.

Further, in the protect layer transfer sheet according to the present invention, the adhesive strength between the release layer and transferable protect layer can be set such that the strength does not vary in accordance with the temperature and the humidity on the condition of preservation and transferring. Therefore, the protect layer transfer sheet according to the present invention has an excellent transferring property of the protect layer. Accordingly, even when the condition of preservation and transferring of the protect layer transfer sheet do not particularly limited, the protect layer can be transferred on an image of a printed product, surely and stably at all times.

In order to achieve the second object of the present invention, the thermally transferable protect layer on the protect layer transfer sheet is made a single-ply structure. A conventional protect layer transfer sheet has needed an adhesive layer for ensuring a good transferability of the protect layer, thereby resulting in a multi-ply structure of the protect layer. Contrary to the conventional art, even if the adhesive layer is arranged on the release layer, the transferability of the protect layer is not deteriorated so much, because the thermally transferable protect layer of the present invention is disposed on the substrate by the medium of the release layer having a good releasing property. By reason as describe above, the protect layer of the present invention can be made the single-ply structure.

The single-ply structure of the thermally transferable protect layer can enhance transparency of the protect layer, and it can also enhance the highest optical density of the image covered with the protect layer. Even if the thermally transferable protect layer has the single-ply structure, it will be possible that a durability desired as for a substitutive technique for the silver photograph is provided to a printed product. Furthermore the single-ply structure of the thermally transferable protect layer can enhance a heat dissipating property of the protect layer transfer sheet to improve a sharpness of the edge of the transferred protect layer, thereby rising productivity and reducing productive cost. Therefore, according to the present invention, a transferred image having a high quality is preferably protected by the thermally transferable protect layer having the single-ply structure.

As described above, according to the protect layer transfer sheet of the present invention, the resin containing the particular high molecular compound is used as the untransferable release layer of the protect layer transfer sheet. Therefore, the adhesive strength between the substrate and the untransferable release layer can always be stronger than the adhesive strength between the untransferable release layer and thermally transferable protect layer, and the adhesive strength between the untransferable release layer and the thermally transferable protect layer before and after adding heat can set up so as to keep a desirable relationship.

Further, On the protect layer transfer sheet according to the present invention, the adhesive strength between the release layer and the transferable protect layer can set up such that the adhesive strength does not vary in accordance with the temperature and humidity during preserving the layer, and the temperature and humidity at the time when the layer is transferred. Therefore, the protect layer transfer sheet according to the present invention has a satisfactory transferring property of the protect layer, and even if the preserving and transferring condition of the protect layer transfer sheet is not limited particularly, the protect layer can be surely and always stably transferred on the images of the printed product.

DESCRIPTION OF THE PREFERRED EMBODIMENTS

The present invention will be explain in detail hereinafter with referring to drawings.

Figure 1:
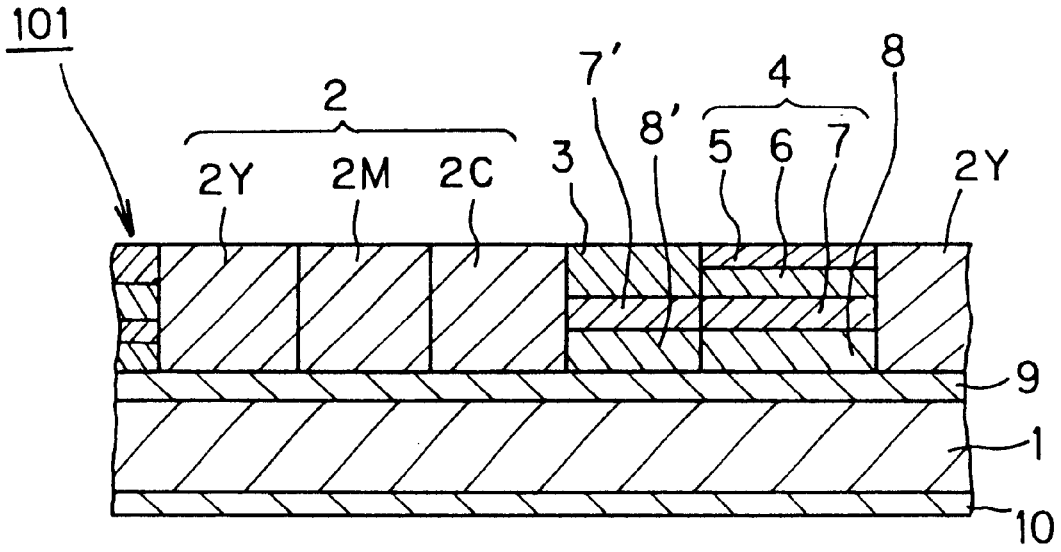
FIG. 1 is a schematically sectional view of one example of a protect layer transfer sheet according to the present invention.
Figure 2:
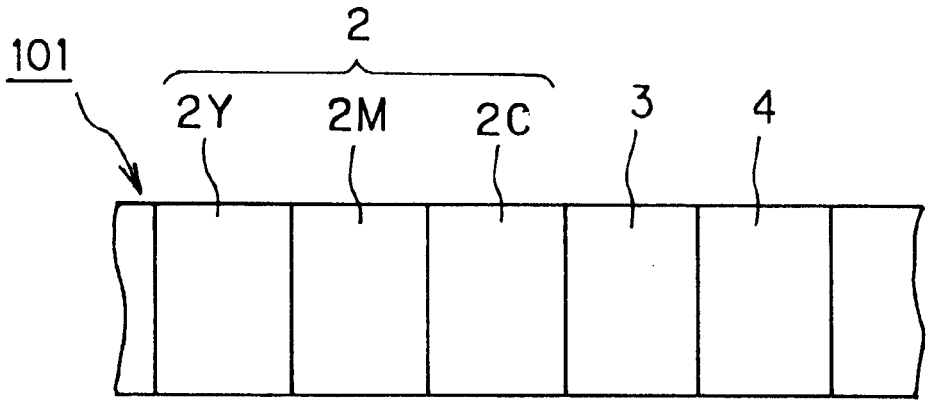
FIG. 2 is a plan view of the protect layer transfer sheet shown in FIG. 1.

FIG. 1 is a schematically sectional view of one example of a protect layer transfer sheet (101) according to the present invention, and FIG. 2 is a plan view of the same protect layer transfer sheet. In the protect layer transfer sheet 101, a primer layer 9 of a solid coating is formed on one surface of a substrate 1, and areas of a sublimation dye layer 2(i.e., a yellow layer 2Y, a magenta layer 2M, and a cyan layer 2C), a heat fusible ink layer 3 and a thermally transferable protect layer 4 are formed on the primer layer 9. Respective areas of the sublimation layers 2Y, 2M, 2C, the heat fusible ink layer 3 and the thermally transferable protect layer 4 are arranged in this order along a surface of the primer layer 9 and in a direction to which the protect layer transfer sheet 101 is conveyed. The above arrangement of those layers is repeated along the direction to which the protect layer transfer sheet 101 is conveyed. The primer layer 9 is formed in order to enhance an adhesiveness between the substrate 1 and the layers (e.x., 2Y, 2M, 2C, and 8) disposed on the substrate 1. On another surface of the substrate 1, a back surface layer 10 providing a heat resistance and a sliding ability to a back surface is formed in order to prevent sticking of the protect layer transfer sheet and a heating means of a printer such as a thermal head.

In an area of the heat fusible ink layer 3, a release layer 8', a protect layer 7' and the heat fusible ink layer 3 are laminated in this order from a boundary portion facing a substrate 1. In an area of the thermally transferable protect layer 4, an untransferable release layer 8, the thermally transferable protect layer 4 are laminated in this order from a boundary portion facing a substrate 1. The thermally transferable protect layer 4 of the protect layer transfer sheet 101 has a multi-ply structure, in which a main protect layer 7, an auxiliary protect layer 6 and an adhesive layer 5 are laminated in this order from a boundary portion near the substrate 1.

When the protect layer transfer sheet 101 is used, a thermal transfer process is carried out to an image receiving surface allotted to a surface of an image receiving sheet or a surface of an article requiring decoration in the following manner with the use of a single or mutually different heating means. That is: (1) in a first step, the dye is thermally transferred from the sublimation dye layer 2 to the image receiving layer to form an image principally composed of a gradational image; (2) in a second step, the heat fusible ink layer 3 is thermally transferred together with the protect layer 7' to form an image which is covered with the protect layer 7' and principally composed of letters, symbols or line drawings; and (3) the thermally transferable protect layer 4 is separated at a boundary of the untransferable release layer 8 and then thermally transferred on the image to cover at least an area where the sublimation dye is transferred.

A satisfactory transferring of the thermally transferable protect layer 4 is achieved by collaboration of an excellent releasing property of the untransferable release layer 8 and an adhesiveness of the adhesive layer 5 as an uppermost portion of the thermally transferable protect layer. It is noted that the untransferable release layer 8 of the present invention which is interposed between the substrate 1 and the thermally transferable protect layer 4 is characterized by its releasing property remarkably excellent in comparison with the conventional release layer.

Though the protect layer transfer sheet 101 described above is an associate type thermal transfer sheet provided with the sublimation dye layer 2 and the heat fusible ink layer 3 as well as the thermally transferable protect layer 4, either or both of the sublimation dye layer 2 and the heat fusible ink layer 3 may be omitted in the present invention. The protect layer transfer sheet of the present invention may be made an independent type protect layer transfer sheet which does not have either or both of the sublimation dye layer 2 and the heat fusible ink layer 3. It is also possible to cover an image formed through a method other than the thermal transfer method with the protect layer by transferring from the protect layer transfer sheet of the present invention.

Figure 3:
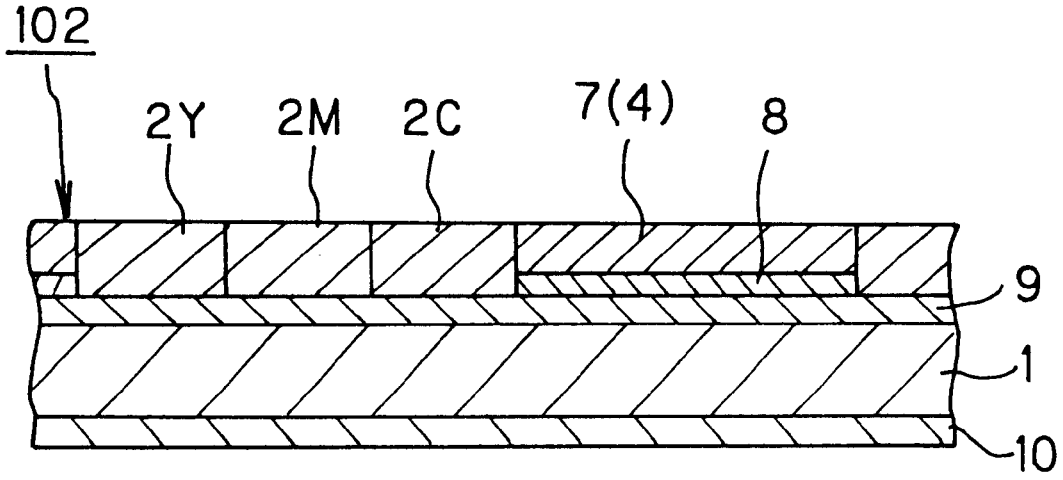
FIG. 3 is a schematically sectional view of another example of a protect layer transfer sheet according to the present invention.

FIG. 3 is a schematically sectional view of another example (102) of a protect layer transfer sheet according to the present invention. The protect layer transfer sheet 102 differs from the protect layer transfer sheet 101 described above in that the former has no heat fusible ink layer and a single-ply structure of the thermally transferable protect layer 4. In the protect layer transfer sheet 102, a primer layer 9 of a solid coating is formed on one surface of a substrate 1, and a sublimation dye layer 2(i.e., a yellow layer 2Y, a magenta layer 2M, and a cyan layer 2C) and a thermally transferable protect layer 4 are formed on the primer layer 9. Respective areas of the sublimation layers 2Y, 2M, 2C and the thermally transferable protect layer 4 are arranged in this order along with a surface of the primer layer 9 and in a direction to which the protect layer transfer sheet 102 is conveyed. The above arrangement of those layers is repeated along the direction to which the protect layer transfer sheet 102 is conveyed. On another surface of the substrate 1, a back surface layer 10 is formed. In an area of the thermally transferable protect layer 4, an untransferable release layer 8 and the thermally transferable protect layer 4 are laminated in this order from a boundary portion facing a substrate 1. The thermally transferable protect layer 4 of this example has the single-ply structure merely composed of a main protect layer 7.

When the protect layer transfer sheet 102 is used, a thermal transfer process is carried out to an image receiving surface allotted to a surface of an image receiving sheet or a surface of an article requiring decoration in the following manner with the use of a single or mutually different heating means. That is: (1) in a first step, the dye is thermally transferred from the sublimation dye layer 2 to the image receiving layer to form an image principally composed of a gradational image; and (2) in a second step, the thermally transferable protect layer 4 having the single-ply structure is separated at a boundary of the untransferable release layer 8 and then thermally transferred on the image formed of the sublimation dye. Since the untransferable release layer 8 of the present invention which is interposed between the substrate 1 and the thermally transferable protect layer 4 has a remarkably excellent releasing property, a satisfactory transferring of the thermally transferable protect layer 4 is achieved without an adhesive layer to increase an adhesive strength between the thermally transferable protect layer 4 and the image receiving surface.

In addition, the single-ply structure of the thermally transferable protect layer 4 as in the protect layer transfer sheet 102 can enhance transparency of the protect layer, and it can also enhance the highest optical density of the image covered with the protect layer, thereby achieving improvement of quality of the image. Even if the thermally transferable protect layer has the single-ply structure, it will be possible that a durability desired as for a substitutive technique for the silver photograph is provided to a printed product. Furthermore the single-ply structure of the thermally transferable protect layer can enhance a heat dissipating property of the protect layer transfer sheet to improve a sharpness of the edge of the transferred protect layer, thereby rising productivity and reducing productive cost. Therefore, a transferred image having a high quality is preferably protected by the thermally transferable protect layer having the single-ply structure.

The protect layer transfer sheet 102 described above is an associate type thermal transfer sheet provided with the sublimation dye layer 2 as well as the thermally transferable protect layer 4, and therefore it is utilized in order to protect an image formed of the sublimation dye. According to the present invention, the protect layer transfer sheet provided with the thermally transferable protect layer having the single-ply structure may also be utilized to satisfactorily protect a highly quality image formed through a method other than the sublimation thermal transfer method. For example, an image formed through an ink jet method may be covered with the thermally transferable protect layer having the single-ply structure with the use of an independent type protect layer transfer sheet of the present invention.

Materials and formation methods for the respective layers of the protect layer transfer sheet will be explain hereinafter.

[Substrate]

As to the substrate 1 of the protect layer transfer sheet of the present invention, a substrate conventionally used for a thermal transfer sheet can be utilized as it is as far as it has a certain extent of heat resistance and strength. As specific examples of the substrate film 1, there will be listed up the following materials: papers which may be a processed paper such as coat paper, polyester such as polyethyleneterephtharate, polystyrene, polypropylene, polysulfone, polyphenylenesulfide, polyethylenenaphthalate, 1,4-polycyclohexylene dimethylterephtharate, aramide, polycarbonate, polyvinyl alcohol, cellophane, or composite film formed by the combination of two or more kinds of these materials. Of these materials, the polyester is preferable, and the polyethyleneterephtharate is particularly preferable. The substrate 1 usually has a thickness of about 0.5 to 50 $\mu$m, and preferably about 3 to 10 $\mu$m. The substrate 1 may have any form such as a sheet type cut into a short size (e.x., B5 or A4) or a continuous film having a long size. Furthermore the primer layer 9 may be formed on one or both surfaces of the substrate 1 as occasion demands in order to increase an adhessiveness between the substrate and layers adjacent thereto.

[Untransferable Release Layer]

The untransferable release layer 8 is disposed on one surface of the substrate 1 in a direct manner or by the medium of one or more intermediate layers such as the primer layer 9. In the present invention, a transferability and a transferring stability of the thermally transferable protect layer 4 is remarkably improved by forming the untransferable release layer 8 which is formed of the cross-linking high molecular compound having the particular chemical structure, thereby making it possible that the protect layer is surely and constantly transferred onto an image formed in a printed product at all times.

The resin formed of the untransferable release layer 8 contains a cross-linked resin having a chemical structure comprises at least a side chain A expressed a following chemical formula 1 and a side chain B expressed a following chemical formula 2 on a principle chain formed of a carbon chain. And in the untransferable release layer at least a part of the side chain A and the side chain B is cross-linking by means of a following addition reaction and/or condensation reaction.

1

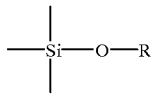

2

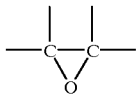

(In the chemical formula, R indicate a hydrogen atom or an alkyl group)

(Addition Reaction)

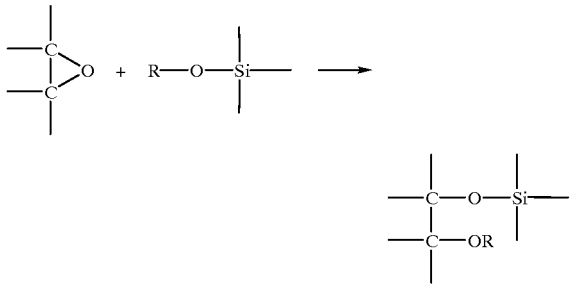

(Condensation Reaction)

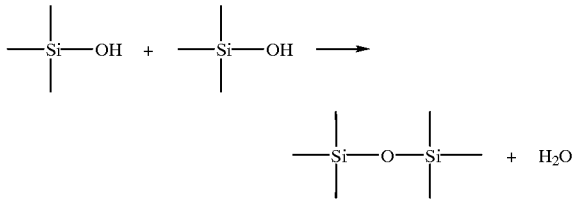

In the present invention, preferably, an amount ratio of the side chain A is within the range of 3–40 weight % with respect to the total weight of the above described high molecular compound When the amount ratio of the side chain A is less than 3 weight %, it is in danger of occurring the transferring defects of the thermally transferable protect layer 4 since the adhesive strength between the untransferable release layer 8 and the thermally transferable protect layer 4 is too high. When the amount ratio of the side chain A is more than 40 weight %, it is in danger of occurring unintentional peeling off and a defective edge of the thermally transferable protect layer 4 since the adhesive strength between the untransferable release layer 8 and the thermally transferable protect layer 4 is too low. Accordingly, because of keeping an amount ratio of the side chain A within the range of 3–40 weight %, the untransferable release layer 8 can be the layer which can transfer the protect layer with an excellent adhesive property regardless of the limitation concerning the preserving and transferring condition, particularly.

Addition to the side chain A and the side chain B, when the principle chain formed of a carbon chain further comprises a side chain C contained —OH group (hydroxyl group), —OH group (hydroxyl group) in the side chain C cross-links with at least a part of the above described side chain A and the side chain B by a following addition reaction and/or a condensation reaction.

(Addition Reaction)

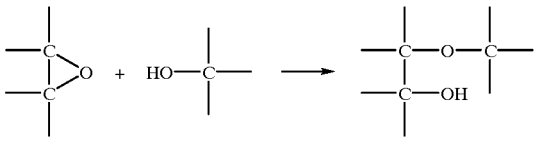

(Condensation Reaction)

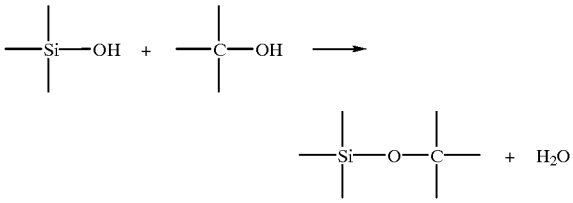

The side chain A and the side chain B may have any chemical structure and are not limited as long as it does not prevent the above described crosslinking reaction, preferably have a following structure from point of view of the reactivity and steric hindrance and the like.

3

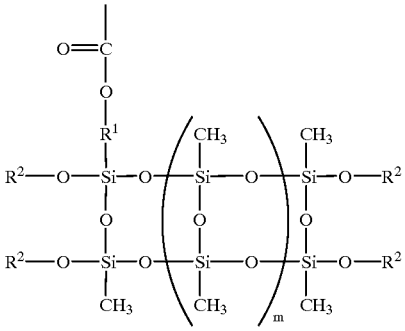

(In the formula, $R^1$ indicates an alkylene group, $R^2$ indicates an alkyl group, and m indicates an integer not less than zero. Each $R^2$ has the same formula or has a different formula.)

4

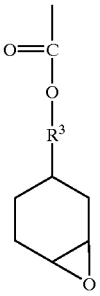

(In the formula, $R^3$ indicates an alkylene group.)

As described above, the untransferable release layer 8 which can achieve an objection of the present invention can be formed by the resin comprising the high molecular compound in which the side chains is crosslinking, as a main constituent. In the untransferable release layer 8, each side chain has both of an intramolecular cross-linking reacting with the side chain of the same molecule and an intermolecular cross-linking reacting with the side chain of the other molecule. However, it is presumed that, for the most part, it has intermolecular crosslinking. Further, according to considerable contribution of the intermolecular crosslinking structure of the crosslinking resin, in the present invention, it is presumed that the untransferable release layer has a extremely stable releasing property.

For the purpose of accelerating the crosslinking reaction, generally, metal chelate compound is preferably added to the untransferable release layer. This metal chelate compound is not limited as long as accelerating the crosslinking reaction. For example, titanium, aluminum, zirconium and the like may be listed as metals, and glycol, β-diketone, hydroxycarboxylic acid, keto ester, keto alcohol and the like may be listed as a ligand to form chelate. Further, a constituent of resin other than the above described crosslinking resin may be mixed to the untransferable release layer as long as it does not prevented the purpose of the present invention.

The untransferable release layer 8 can be formed by preparing a coating solution containing the crosslinking resin having the above described chemical structure, the above described metal chelate compound, the other resin constituent, additive and the like, applying the thus prepared coating solution on the substrate 1 through a known coating method such as gravure coating, gravure reverse coating, and then drying the same. The untransferable release layer 8 usually has a thickness of about 0.1 to 2 μm in a dried state. Further, it is preferable that a drying process conducts at the temperature of not less than 90° C., generally, since the high molecular compound mainly composing untransferable release layer 8 has to cross-link sufficiently. When the drying temperature is low and the cross-linking reaction does not react sufficiently, the adhesive strength at an interface of the release layer 8 and the transferable protect layer 4 become strong, as a result, the so-called unusual transferring such as sticking, thermal fusion, or robbing of the release layer may occur.

The untransferable release layer 8 formed by such manufacturing process is extremely hard compared with the conventional release layer, and has an excellent heat-resistance property. Thus, it has an excellent property such that the surface of the protect layer transferred on the printed product becomes satisfactory glossiness.

When an image receiving surface of a printed product is desired to be covered with a protect layer having a mat feeling, a mat surface of the thermally transferable protect layer 4 can be formed by: adding various particles into the release layer, or previously subjecting a surface of the release layer to a mat work; and thereafter laminating the thermally transferable protect layer on the release layer.

[Thermally Transferable Protect Layer]

The thermally transferable protect layer 4 which is laminated on the substrate 1 by the medium of the untransferable release layer 8 may have a multi-ply structure as shown in FIG. 1 or a single-ply structure as shown in FIG. 3. The thermally transferable protect layer having the multi-ply structure is mainly composed of a main protect layer 7 which is the most important to provide various durability to the image, and furthermore it may be provided with an adhesive layer 5 disposed at the uppermost portion of the thermally transferable protect layer in order to increase an adhesiveness between the thermally transferable protect layer and the image receiving surface of the printed product, an auxiliary protect layer 6, and another layer to provide a function other than a fundamental function of the protect layer. Though an order of the main protect layer and the other layers is optional, the adhesive layer 5 and the main protect layer 7 are usually arranged at an uppermost side and a lowermost side respectively, and the other layers are arranged between them so as to position the main protect layer at an uppermost portion of the image receiving surface after the transfer. In the present invention, even if the thermally transferable protect layer is made the single-ply structure without the adhesive layer, a remarkably satisfactory transferring of the thermally transferable protect layer is achieved, because the untransferable release layer 8 has a remarkably excellent releasing property.

The main protect layer 7 included in the thermally transferable protect layer having the multi-ply structure or the thermally transferable protect layer having the single-ply structure may be formed of various resins which are conventionally known as a resin for formation of the protect layer. The following resins may be exemplified as the resin for formation of the protect layer: polyester resin, polystyrene resin, acrylic resin, polyurethane resin, acrylic urethane resin, silicone-modified resin derived from those resins, a mixture of those resins, ionizing radiation hardenable resin, and ultraviolet shielding resin.

The protect layer containing the ionizing radiation hardenable resin is excellent in a resistance to plasticizer or a resistance to rubbing. There can be used a known ionizing radiation hardenable resin, which may be synthesized in the following manner. That is, a polymer or oligomer reactive for a radical polymerization is cross-linked by irradiation of the ionizing radiation to be hardened, or a polymer or oligomer reactive for the radical polymerization into which a light polymerization initiator is added as occasion demands is polymerized by an electron beam or an ultraviolet ray to be cross-linked.

A primary purpose of the protect layer containing the ultraviolet shielding resin is to provide a light-resisting property to the printed product. There may be used, as the ultraviolet shielding resin, a resin obtained by reacting and linking a reactive ultraviolet absorber with the above described ionizing radiation hardenable resin or a thermoplastic resin. Specific examples of such an ultraviolet shielding resin include those prepared by incorporating a double bond structure reactive for addition polymerization such as vinyl radical ,acryloyl radical, methacyloyl radical or the like or another reactive radical or moiety such as alcoholic hydroxyl group, amino group, carboxylic group, epoxy group, isocyanate group or the like into a non-reactive organic ultraviolet absorber conventionally known such as salicylate, benzophenone, benzotriazol, substituted acrylonitrile, nickel chelate or hindered amine.

The thermally transferable protect layer 4 having the single-ply structure and the main protect layer 7 in the multi-ply structure are made to have an appropriate thickness in consideration of a kind of the resin forming the protect layer, and usually have a thickness of about 0.5 to 10 $\mu$m.

The adhesive layer 5 may be formed at an uppermost portion of the thermally transferable protect layer 4. There is exemplified, as a material for the adhesive layer, a resin having a good adhesiveness at a heating time such as acrylic resin, polyvinyl chloride resin, polyvinyl acetate resin, vinyl chloride—vinyl acetate copolymer resin, polyester resin or polyamide resin. The adhesive layer 5 usually has a thickness of about 0.1 to 5 $\mu$m.

In one method to form the thermally transferable protect layer 4 on the untransferable release layer 8, coating solutions such as a coating solution for the protect layer containing a resin forming the protect layer, another coating solution for the adhesive layer containing a thermally adhesive resin and still another coating solution forming a layer to be optionally formed are previously prepared, and the thus prepared coating solutions are applied and dried on the untransferable release layer 8 in a prescribed order. Any coating method conventionally known may be carried out for applying of the coating solutions. Furthermore appropriate primer layers may be formed between the respective layers.

[Coloring Material Layer]

In the protect layer transfer sheet of the present invention, one or more coloring material layers such as the sublimation dye layer 2 and the heat fusible ink layer 3 may be formed in addition to the thermally transferable protect layer 4 so as to laterally arrange them along a surface of the protect layer transfer sheet. Any conventionally known sublimation dye layers and heat fusible ink layers can be utilized in the present invention.

In one method, the sublimation dye layer 2(2Y, 2M, 2C) is formed by dissolving a sublimation dye of yellow, magenta or cyan in a solvent together with an appropriate binder resin, release agent and another additive to prepare a coating solution of one or more colors, applying the each coating solution on a prescribed area of the substrate in a known manner, and then drying same. The following dyes may be exemplified as the yellow sublimation dye: Disperse Yellow 231 (e.x., PHORONE BRILLIANT YELLOW -S-6GL manufactured by Sandoz Co., Ltd.), and Disperse Yellow 201 (e.x., MACROLEX YELLOW 6G manufactured by Bayer Co., Ltd.). As the magenta sublimation dye, the following dyes may be exemplified: Disperse Red 60 (e.x., MS RED G manufactured by Mitsui Toatsu Co., Ltd.), and Disperse Violet 26 (e.x., MACROLEX VIOLET R manufactured by Bayer Co., Ltd.). As the cyan sublimation dye, the following dyes may be exemplified: Solvent Blue 63 (e.x., KAYASET BLUE 714 manufactured by Nihon Kayaku Co., Ltd.), Disperse Blue 354 (e.x., PHORONE BRILLIANT BLUE S-R manufactured by Sandoz Co., LTD.), and Solvent Blue 36 (e.x., Waxoline AP-FWmanufactured by ICI Co., LTD.).

Furthermore the following resins may be exemplified as a binder resin for the sublimation dye layer: a cellulose resin such as ethyl cellulose, ethyl hydroxy cellulose, hydroxypropyl cellulose, methyl cellulose or cellulose acetate; vinyl resin such as polyvinyl alcohol, polyvinyl acetate, polyvinyl butyral, polyvinyl acetal or polyvinyl pyrrolidone; acrylic resin such as poly(metha)acrylate or poly(metha) acrylic amide; polyurethane resin; polyamide resin; polyester resin; and a mixture of those resins. Among these, polyvinyl butyral and polyvinyl acetal are preferable from points of transferability of the dye and preservability of the protect layer transfer sheet.

The heat fusible ink layer 3 may be formed in the following manner. That is, the primer layer 9, the release layer 8' for the heat fusible ink layer 3 and the protect layer 7' for the heat fusible ink layer 3 or another layer is previously formed on the substrate 1 as occasion demands. Then a heat fusible ink containing a coloring material, vehicle and another additive is applied on the layer already formed through a known coating method such as a hot melt coating, a hot lacquer coating, gravure coating, gravure reverse coating, or roll coating. The heat fusible ink layer 3 usually has 0.2 to 10 $\mu$m.

The release layer 8' for the heat fusible ink layer 3 may be formed of either one of the same materials as the untransferable release layer 8 and a material forming an usual release layer. The protect layer 7' for the heat fusible ink layer 3 may be formed of either one of the same materials as the main protect layer 7 described above and a different material.

As a coloring material for the heat fusible ink layer 3, it is preferable to use a black coloring material. The black coloring material is convenient when a main purpose of the heat fusible ink layer is to record highly dense and clear letters, marks or symbols. There may be used as a material for the vehicle: for example, wax, and a mixture containing any one of drying oil, resin, mineral oil, cellulose and a derivative of rubber together with the wax. Specific examples of the wax include microcrystalline wax, carnauba wax, paraffin wax, Fischer-Tropsch's wax, low molecular polyester wax, Japan tallow, bees wax, cetaceum, insect wax, wool wax, shellac wax, candelilla wax, petrolatum, partially modified wax, fatty acid ester, and fatty acid amide.

[Back Surface Layer]

It is preferable to form the back surface layer 10 having a heat resistant slipping property (i.e., a slipping property effective even at a high temperature) and a releasing property on a back surface of the substrate 1 which is not provided with any of the thermally transferable protect layer 4, the sublimation dye layer 2 and the heat fusible ink layer 3. The back surface layer is formed for the purposes of prevention of a heat fusion between the back surface and a heating means such as a thermal head, improvement of a paper feeding, prevention of a blocking between the back surface and the dye layer or the ink layer which is caused when the protect layer transfer sheet is rolled up, or the like. The back surface layer 10 may be formed of a separating agent such as hardenable silicone oil, hardenable silicone wax, silicone resin, fluororesin, acrylic resin or the like.

EXAMPLE

Hereunder, the protect layer transfer sheet according to the present invention will be more concretely explained by way of preferred examples executed. Units of "part(s)" and "%" described in the following examples mean "weight part(s)" and "weight %" respectively as far as a particular note is not there.

[Preparation Example of Sublimation Transfer Sheet]

A sublimation transfer sheet to be used for evaluation of protect layer transfer sheets of the examples was prepared. A polyethylene terephthalate film (LUMIRROR, manufactured by Toray Co., Ltd.) having a thickness of 6 $\mu$m was used as a substrate. A primer layer of an urethane resin having a thickness of 0.5 $\mu$m was formed on one surface of the substrate, and a heat resistant slip layer having a thickness of 1 $\mu$m was formed on another surface, i.e., the back surface of the substrate. Next, inks of three colors each of which contained a sublimation dye were prepared. The inks thus prepared had the following compositions respectively.

<Composition of Yellow Ink>

Quinophthalone dye expressed by the following formula: 5.5 weight parts Polyvinyl butyral: 4.5 weight parts (ETHLEC BX-1, manufactured by Sekisui Kagaku Kogyo Co., Ltd.)

Methyl ethyl ketone/Toluene (1/1):90.0 weight parts

[Formula of Quinophthalone Dye]

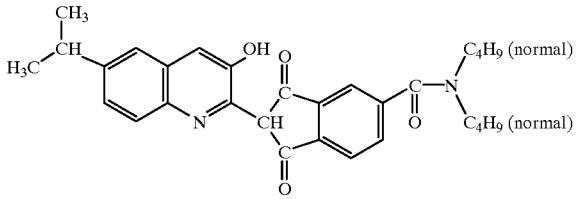

<Composition of Magenta Ink>

A magenta ink was prepared in the same manner as in the preparation of the yellow ink except that C.I. Disperse Red 60 was used as a dye instead of the yellow dye of the above formula.

<Composition of Cyan Ink>

A cyan ink was prepared in the same manner as in the preparation of the yellow ink except that C.I. Solvent Blue 63 was used as a dye instead of the yellow dye of the above formula.

The thus prepared inks were applied, through the gravure printing, on the primer layer already formed on the polyester substrate so as to arrange the yellow, the magenta and the cyan in this order along the surface of the substrate and in a lengthwise direction, and then dried, thereby obtaining a sublimation thermal transfer sheet having sublimation dye layers of three colors. In the sublimation thermal transfer sheet, the each dye layer had a length of 15 cm, and plural sets of yellow, magenta and cyan are repeated. An applied amount of the each dye layer was about 3 g/m$^2$ in a solid component.

[Preparation Example of Thermal Transfer Image Receiving Sheet]

A thermal transfer image receiving sheet to be used for evaluation of protect layer transfer sheets of the examples was prepared. A synthesized paper (YUPO FPG-150, manufactured by Ohji Yuka Co., Ltd.) having a thickness of 150 $\mu$m is used as a substrate sheet. A coating solution for a dye receptor layer having the following composition was applied on one surface of the substrate sheet by means of a bar coater, and then dried same, thereby forming a dye receptor layer having an applied amount of 4 g/m$^2$ in a dried state. Thus the thermal transfer image receiving sheet was obtained.

<Composition of Coating Solution for Dye Receptor Layer>

Vinyl chloride—vinyl acetate copolymer: 20.0 weight parts (DENKA VINYL 1000A, manufactured by Denki Kagaku Co., Ltd.)

Epoxy-modified silicone oil: 1.0 weight parts (X-22-3000T, manufactured by Shinetsu Kagaku Co., Ltd.)

Methyl ethyl ketone/Toluene (1/1): 80.0 weight parts

[Chemical Structure of Resin A, Resin B, and Resin C for Untransferable Release Layer]

Resin A, resin B, and resin C, used in the example 1 to 4 described later, have a basic structure expressed a following chemical formula 5. That is, they have a carbon chain as a principal chain, and have a side chain A expressed the formula 3, a side chain B expressed the formula 4, and a side chain contained —OH group. The resin A, the resin B, and the resin C have the same basic chemical structure each other, however, they are different concerning the component proportion ratio. The followings are the component proportion ratio of each side chain of the resin A, the resin B, and the resin C.

<Component Proportion Ratio of Side Chain>

Resin A;

The component proportion ratio(the weight ratio) of the side chain A and the side chain B is A:B=1:4, and Y=0.

Resin B;

The component proportion ratio(the weight ratio) of the side chain A and the side chain B is A:B=1:9, and Y=0.

Resin C;

The component proportion ratio(the weight ratio) of the side chain A and the side chain B is A:B=1:4, and Y≧1.

5

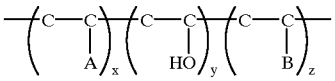

[In the formula, A indicates the side chain A, B indicates the side chain B. And, x, y, and z indicate the integer not less than zero.]

3

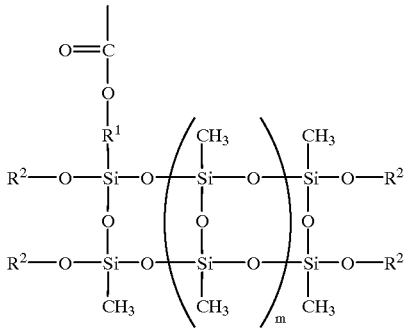

(In the formula, $R^1$ indicates an alkylene group, $R^2$ indicates an alkyl group, and m indicates the integer not less than zero. Each $R^2$ has the same formula or has a different formula.)

4

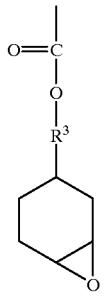

(In the formula, $R^3$ indicates an alkylene group.)

Example 1

A polyethylene terephthalate film (LUMIRROR, manufactured by Toray Co., Ltd.) having a thickness of 12 μm was used as a substrate. A layer of a silicone resin having a thickness of 1 μm was formed as a heat resistant slip layer on one surface through the gravure coating method. And a coating solution for a release layer 1 having the following composition was applied on another surface of the substrate through the gravure coating method to form a release layer having an applied amount of 0.6 g/m$^2$ in a dried state.

<Composition of Coating Solution for Release Layer 1>

| | |
|---|---|
| Resin A | 19 weight parts |
| Aluminum chelate compound (manufactured by KAWAKEN FINE CHEMICALS CO., LTD.) | 1 weight parts |
| MEK (methyl ethyl ketone) | 40 weight parts |
| Toluene | 40 weight parts |

Thereafter a coating solution for a transferable protect layer having the following composition was applied on thus formed release layer through the gravure coating method to form a transferable protect layer having an applied amount of 3.0 g/m$^2$ in a dried state through applying and drying. Thus a protect layer transfer sheet of the example 1 was obtained.

<Composition of Coating Solution for Transferable Protect Layer>

Vinyl chloride—vinyl acetate copolymer: 15 weight parts (DENKA VINYL 1000ALK, manufactured by Denki Kagaku Co., Ltd.)

Copolymer resin reacted and linked with a reactive ultraviolet absorber: 20 weight parts (UVA635L, manufactured by BASF Japan Co., Ltd.)

Methyl ethyl ketone/Toluene (1/1): 100 weight parts

Example 2

A protect layer transfer sheet of the example 2 was manufactured in the same manner as in the example 1 except that a coating solution for a release layer 2 having the following composition was used instead of the coating solution for a release layer 1.

<Composition of Coating Solution for Release Layer 2>

| | |
|---|---|
| Resin B | 19 weight parts |
| Aluminum chelate compound (manufactured by KAWAKEN FINE CHEMICALS CO., LTD.) | 1 weight parts |
| MEK (methyl ethyl ketone) | 40 weight parts |
| Toluene | 40 weight parts |

Example 3

A protect layer transfer sheet of the example 3 was manufactured in the same manner as in the example 1 except that a coating solution for a release layer 3 having the following composition was used instead of the coating solution for a release layer 1.

<Composition of Coating Solution for Release Layer 3>

| | |
|---|---|
| Resin C | 19 weight parts |
| Aluminum chelate compound (manufactured by KAWAKEN FINE CHEMICALS CO., LTD.) | 1 weight parts |
| MEK (methyl ethyl ketone) | 40 weight parts |
| Toluene | 40 weight parts |

Example 4

A protect layer transfer sheet of the example 4 was manufactured in the same manner as in the example 1 except that a coating solution for a release layer 4 having the following composition was used instead of the coating solution for a release layer 1.

<Composition of Coating Solution for Release Layer 4>

Resin C: 19 weight parts

Vinyl chloride—vinyl acetate copolymer: 2 weight parts (DENKA VINYL 1000GK, manufactured by Denki Kagaku Co., Ltd.)

| | |
|---|---|
| Aluminum chelate compound (manufactured by KAWAKEN FINE CHEMICALS CO., LTD.) | 1 weight part |
| MEK (methyl ethyl ketone) | 40 weight parts |
| Toluene | 40 weight parts |

Comparative Example 1

A protect layer transfer sheet of the comparative example 1 was manufactured in the same manner as in the example 1 except that a coating solution for a release layer 5 having the following composition was used instead of the coating solution for a release layer 1.

<Composition of Coating Solution for Release Layer 5>

Polyvinyl alcohol: 4 weight parts (KURARAY poval: manufactured by Kuraray Co., Ltd.)

Urethane resin: 1 weight part (manufactured by DAINIPPON INK & CHEMICALS INC.)

Water: 54 weight parts

Ethanol: 40 weight parts

Comparative Example 2

A protect layer transfer sheet of the comparative example 2 was manufactured in the same manner as in the comparative example 1 except that a coating solution for a release layer 6 having the following composition was used instead of the coating solution for a release layer 1.

<Composition of Coating Solution for Release Layer 6>

Polyvinyl alcohol: 3 weight parts (KURARAY poval: manufactured by Kuraray Co., Ltd.)

Urethane resin: 3 weight part (manufactured by DAINIPPON INK & CHEMICALS INC.)

Water: 54 weight parts

Ethanol: 40 weight parts

Evaluation

The sublimation thermal transfer sheet was laid on the thermal transfer image receiving sheet so as to face a dye layer of the former to a receptor layer of the latter, and a thermal head of a printer was operated in accordance with electric signals obtained by a color separation of a photograph of a portrait to apply a heating energy, thereby forming an image with completely reproduced colors, i.e., full colors.

Then the protect layer transfer sheets of the examples 1 to 4 or the comparative examples 1 and 2 were laid on the thus formed image of the thermal transfer image receiving sheet, and transferring of a protect layer was carried out with the use of the same printer as used to form the image. The transfer is conduct under the condition at the temperature of 25° C. and the humidity of 50%, and the condition at the temperature of 40° C. and the humidity of 90%. Thereafter, transferability of the protect layer, i.e., appearance of an unusual transferring, sticking, and sharpness of an edge of a transferred protect layer was evaluated. Furthermore an adhesive strength between the release layer and the transferable protect layer of each protect layer transfer sheet was measured before and after applying of the heating energy in the following manner. Results of the evaluation and the measurement were shown in Table 1 and Table 2.

<Measurement of Adhesive Strength before Heating>

An adhesive tape of a vinyl resin having a width of 10 cm was stuck on a surface of the protect layer of the protect layer transfer sheet, and the adhesive tape is stripped from the protect layer transfer sheet by drawing the adhesive tape so as to be turned over in a lengthwise direction of the adhesive tape at an angle of 180 degree, and then a stripping strength required in the above stripping step was measured.

<Measurement of Adhesive Strength after Heating>

The protect layer transfer sheet was laid on the thermal transfer image receiving sheet, and a solid pattern having a width of 10 cm was printed out by means of the same printer as used for forming the image. Thereafter the thermal transfer image receiving sheet was stripped from the protect layer transfer sheet by drawing the thermal transfer image receiving sheet so as to be turned over in a lengthwise direction of the thermal transfer image receiving sheet at an angle of 180 degree, and then a stripping strength required in this stripping step was measured.

TABLE 1

| | Transferability | | | Adhesive Strength | |
|---|---|---|---|---|---|
| | Unusual Trans-ferring | Sharpness of Edge of Transferred Protect Layer | Sticking | Before and After Heating (gf/cm) Before | After |
| Example 1 | Non | Good | Non | 8 | ≦1 |
| Example 2 | Non | Good | Non | 12 | ≦1 |
| Example 3 | Non | Good | Non | 8 | ≦1 |
| Example 4 | Non | Good | Non | 5 | ≦1 |
| Comparative Example 1 | Robbing of Protect Layer | Left Portion Having Length More than 5 mm at Edge Portion | Non | 1 | 1 |
| Comparative Example 2 | Non | Good | Sticking | 10 | 9 |

Note
Evaluation Condition: temperature; 25° C., Humidity; 50%

TABLE 2

| | Transferability | | |
|---|---|---|---|
| | Unusual Transferring | Sharpness of Edge of Transferred Protect Layer | Sticking |
| Example 1 | Non | Good | Non |
| Example 2 | Non | Good | Non |
| Example 3 | Non | Good | Non |
| Example 4 | Non | Good | Non |
| Comparative Example 1 | Robbing of Protect Layer On all surface | Left Portion Having Length Not Less than 10 mm At Edge Portion | Non |
| Comparative Example 2 | Thermal Fusion | — | — |

Note) evaluation condition: temperature; 40° C., humidity; 90%

As described above, even when the protect layer is transferred under the condition of high temperature and high humidity, it showed the satisfied transferring property.

What is claimed is:

1. A protect layer transfer sheet comprising a substrate, an untransferable release layer and a thermally transferable protect layer, in which the protect layer is disposed on at least one area of a surface of the substrate by the medium of the release layer, wherein the untransferable release layer comprises at least a cross-linking resin having a chemical structure which comprises at least a side chain A expressed by the following chemical formula 1 and a side chain B expressed by the following chemical formula 2 on a principle chain formed of a carbon chain, and cross-linking at least a part of the side chain A and the side chain B:

Formula 1

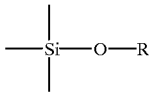

Formula 2

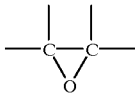

wherein R indicates a hydrogen atom or an alkyl group.

2. A protect layer transfer sheet according to claim 1, wherein an amount ratio of the side chain A is within the range of 3–40 weight % with respect to the total weight of the high molecular compound.

3. A protect layer transfer sheet according to claim 2, wherein the cross-linking resin further comprises —OH group as a side chain C.

4. A protect layer transfer sheet according to claim 1, wherein the cross-linking resin further comprises —OH group as a side chain C.

5. A protect layer transfer sheet according to claim 1, 2, 4 or 3, wherein the side chain A has a chemical structure expressed by the following chemical formula 3, and the side chain B has a chemical structure expressed by the following formula 4, respectively:

Formula 3

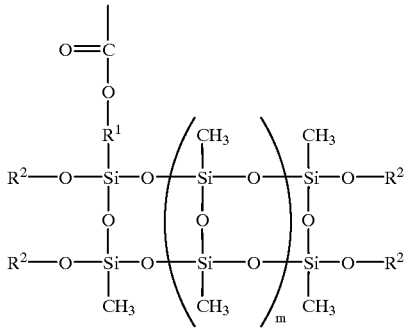

wherein $R^1$ indicates an alkylene group, $R^2$ indicates an alkyl group, m indicates an integer not less than zero, and $R^2$ has the same formula or has a different formula;

Formula 4

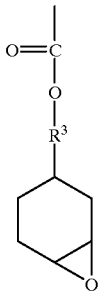

wherein $R^3$ indicates an alkylene group.

* * * * *